US005600184A

United States Patent [19]

Shiga et al.

[11] Patent Number: 5,600,184

[45] Date of Patent: Feb. 4, 1997

[54] STARTER HAVING LINK BETWEEN PINION REGULATOR AND MAGNET SWITCH

[75] Inventors: Tsutomu Shiga, Nukata-gun; Nobuyuki Hayashi, Nagoya; Masanori Ohmi, Anjo; Masami Niimi, Handa, all of Japan

[73] Assignee: Nippondenso Co., Ltd., Kariya, Japan

[21] Appl. No.: 407,077

[22] Filed: Mar. 20, 1995

[30] Foreign Application Priority Data

Sep. 19, 1994 [JP] Japan ..... 6-222323

[51] Int. Cl.[6] ..... F02N 11/00

[52] U.S. Cl. ..... 290/38 R; 290/48

[58] Field of Search ..... 290/48, 38 R, 290/38 A, 38 B, 38 C, 38 D, 38 E; 254/199, 264, 384; 24/275, 276, 277, 298, 32, 135 R; 74/500.5, 502.5

[56] References Cited

U.S. PATENT DOCUMENTS

| | | | |
|---|---|---|---|
| 1,788,713 | 1/1931 | Good et al. | 290/28 |
| 1,941,698 | 1/1934 | Lock | 290/38 C |
| 2,332,086 | 10/1943 | Jones | 290/38 A |
| 2,396,986 | 3/1946 | Buxton | 290/38 A |
| 2,882,421 | 4/1959 | Mendenhall | 290/38 A |
| 2,925,810 | 2/1960 | Mendenhall | 123/179.3 |
| 3,496,759 | 2/1970 | Buxton | 74/7 R |
| 5,293,785 | 3/1994 | Lichtenberg | 74/500.5 |

FOREIGN PATENT DOCUMENTS

| | | |
|---|---|---|
| 2552823 | 4/1985 | France . |
| 2625770 | 7/1989 | France . |
| 390972 | 6/1932 | United Kingdom . |
| 390972 | 4/1933 | United Kingdom . |

*Primary Examiner*—Steven L. Stephan
*Assistant Examiner*—Christopher Cuneo
*Attorney, Agent, or Firm*—Cushman, Darby & Cushman

[57] ABSTRACT

In order to absorb the impact force produced when a pinion meshes a ring gear, a magnet switch is disposed apart from a pinion. The distance between a plunger of the magnet switch and a pinion rotation regulating member is lengthened so that a link mechanism having an elastic member such as a cord-shaped member or a spring is lengthened. As a result, the impact force produced when the pinion meshes the ring gear can be prevented from being directly transmitted to the plunger. Consequently, there is no vibration of the plunger and a movable contact can be reliably prevented from moving away from a fixed contact.

14 Claims, 13 Drawing Sheets

STARTER HAVING LINK BETWEEN PINION REGULATOR AND MAGNET SWITCH

CROSS REFERENCE TO RELATED APPLICATION

This application is based on and claims priority of Japanese Patent Application No. 6-222323, filed Sep. 19, 1994, the content of which is incorporated herein.

BACKGROUND OF THE INVENTION

1. Field of the Invention

The present invention generally relates to a starter for starting engines. More patrticularly, the present invention relates to a starter with a pinion and a magnet switch which are disposed apart from each other and connected via a link mechanism.

2. Related Art

As disclosed in U.K. Patent No. 390,972, the conventional starter conveyed the rotation of a starter motor to a ring gear of an engine via a pinion. With this construction, a lever is rotated with movement of a magnet switch plunger and a friction member on the lever is press-fitted to the pinion. Using the frictional force of the friction member and the pinion, the pinion is advanced with the rotation of a shaft by the motor, and the pinion and the ring gear are engaged. In other words, by rotating the lever together with the movement of the magnet switch plunger, the friction member is press-fitted with the pinion.

With the conventional construction, however, the magnet switch is disposed near the pinion and the distance between the plunger of the magnet switch and the pinion is short. Therefore the impact force produced when the pinion meshes the ring gear and transmitted directly through the lever to the plunger of the magnet switch causes the fixed contact to move away from the movable contact in the magnet switch. Further, abrasion and the like between the plunger and the coil to attract the plunger due to the unusual stress to the plunger prevents the plunger from moving normally.

SUMMARY OF THE INVENTION

In view of the above problem, the present invention has a primary object to provide a starter motor which is reliable in operation.

The present invention has a further object to provide an improved arrangement of a magnet switch, a pinion and a ink mechanism.

In a starter according to the present invention, a magnet switch is disposed on the opposite side of a pinion from a starter motor keeping the distance between a plunger of the magnet switch and the pinion being lengthened. A link mechanism provided between the plunger and the pinion regulating member is lengthened. As a result, because the impact force produced when the pinion meshes a ring gear can be absorbed by the link mechanism and is not directly transmitted to the plunger of the magnet switch. The disengagement between a movable contact and a fixed contact can be reliably prevented in the magnet switch. Furthermore, the restriction in mounting the starter to the engine is reduced and the mountability of the starter on the engine is improved.

Preferably, the pinion is moved through a cord-shaped member to the ring gear side via pinion moving member. The number of parts can be reduced. Even if the pinion meshes the ring gear and fails to move away therefrom, bending in the cord-shaped member itself causes the plunger to return to its original position, and the movable contact can reliably move away from the fixed contact in the magnet switch. The cord-shaped member as a link member comprises a wire, the durability can be increased.

Preferably, an adjusting mechanism is disposed between the plunger and the cord-shaped member so that the length of the cord-shaped member can be easily adjusted. The adjusting mechanism is screwed into a hole portion of the plunger so that the length of the cord-shaped member can be easily adjusted.

Preferably, a supporting member is disposed so that the extending direction of the cord-shaped member can be adjusted. Therefore, in the state that the other members are fixed on both ends of the cord-shaped member, even if the length of the cord-shaped member varies due to variations in the producing process, the positions of the other members fixed on both ends of the cord-shaped member can be accurately set at the required positions.

Preferably, a regulating member is moved to the pinion side to regulate the rotation of the pinion so that strong force to engage by friction the regulating portion against the pinion is no longer necessary and the regulating portion can be reliably moved by the cord-shaped member.

DETAILED DESCRIPTION OF THE PRESENTLY PREFERRED EMBODIMENTS

Figure 1:
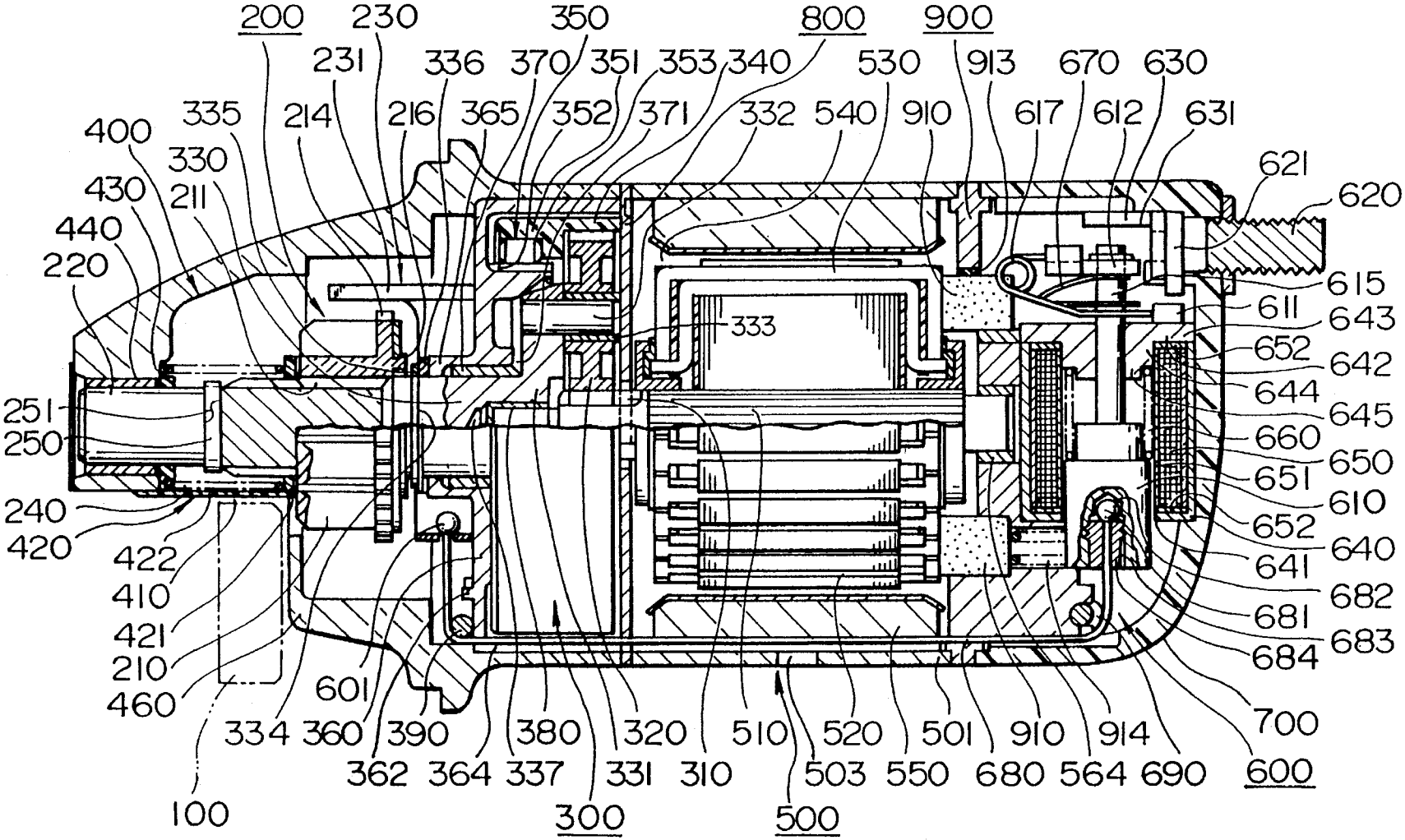
FIG. 1 is a sectional side view showing the first embodiment of a starter of the present invention.

A starter according to this invention will be described in detail based on the embodiments shown in FIG. 1 through FIG. 18.

[FIRST EMBODIMENT]

The starter according to the first embodiment can be generally divided into a housing 400 containing a pinion 200 which meshes a ring gear 100 mounted on an engine and a speed reduction mechanism 300, a motor 500, an end frame 700 containing a magnet switch 600. Inside the starter, the housing 400 and the motor 500 are separated by a motor spacer wall 800, and the motor 500 and the end frame 700 are separated by a brush holding member 900.

[PINION 200]

Figure 3A:
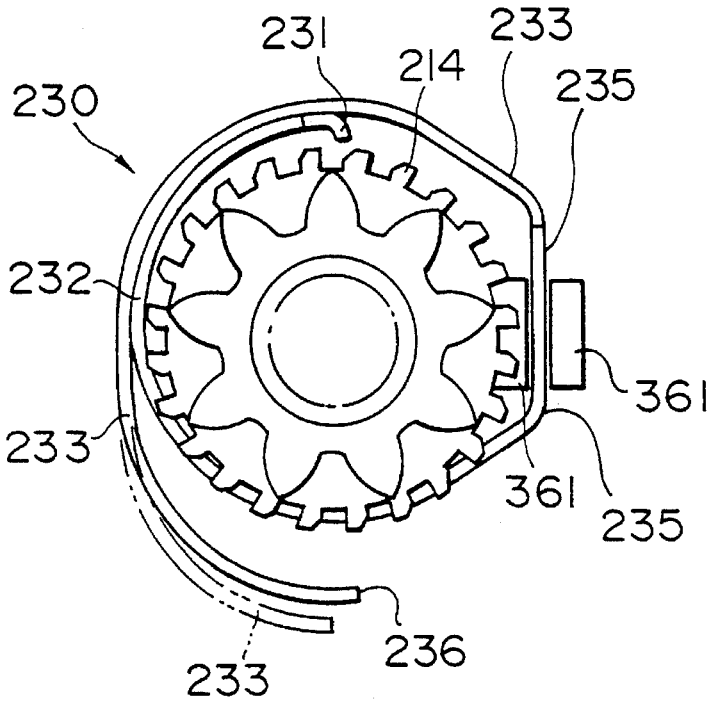
FIGS. 3A and 3B are a front view and a partial sectional side view of a pinion rotation regulating member fitted to a pinion part.
Figure 3B:
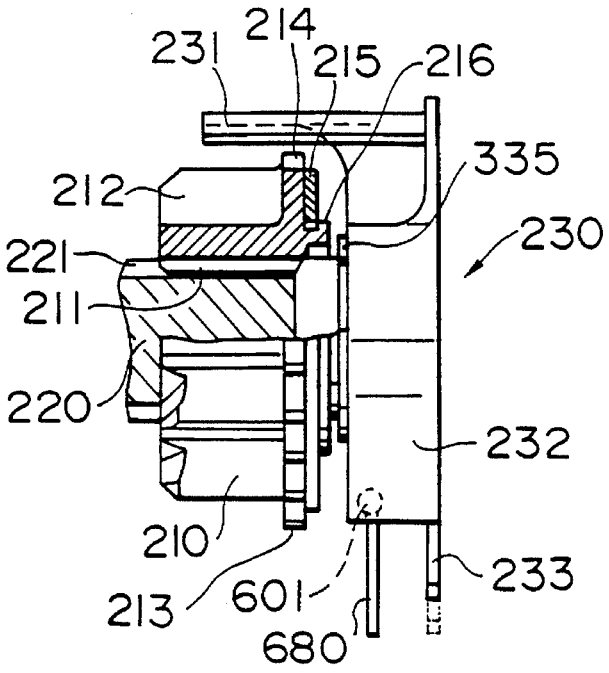

As shown in FIG. 1 or FIGS. 3A and 3B, a pinion gear 210 which meshes the ring gear 100 of the engine is formed on the pinion 200. A pinion helical spline 211 which mates with a helical spline 221 formed on an output shaft 220 is formed around the inner surface of the pinion gear 210.

On the opposite side of the pinion gear 210 from the ring gear 100, a flange 213 of greater diameter than the external diameter dimension of the pinion gear 210 is formed in circular form. A number of projections 214 greater than the number of outer teeth of the pinion gear 210 are formed around the entire outer circumference of this flange 213. These projections 214 are for a regulating claw 231 of a pinion rotation regulating member 230 which will be discussed later to mate with. A washer 215 is bent onto the outer peripheral side of an annular portion 216 formed on the rear end of the pinion gear 210 and thereby disposed rotatably and unable to come off in the axial direction on the rear surface of the flange 213.

By the rotatable washer 215 being mounted on the rear surface of the flange 213 of the pinion gear 210 in this way, when a pinion rotation regulating member 230 which will be discussed later drops in behind the pinion gear 210, the front end of a regulating claw 231 of the pinion rotation regulating member 230 abuts the washer 215. As a result, the rotation of the pinion gear 210 does not directly abut the regulating claw 231 of the pinion rotation regulating member 230, and the washer 215 rotates relatively and the pinion gear 210 is prevented from being worn by the regulating claw 231 of the pinion rotation regulating member 230.

The pinion gear 210 is urged toward the rear of the output shaft 220 at all times by a return spring 240 consisting of a compression coil spring. The return spring 240 not only urges the pinion gear 210 directly but in this embodiment urges the pinion gear 210 by way of a ring body 421 of a shutter 420 which opens and closes an opening portion 410 of the housing 400 and will be further discussed later.

[PINION ROTATION REGULATING MEMBER 230]

Figure 2:
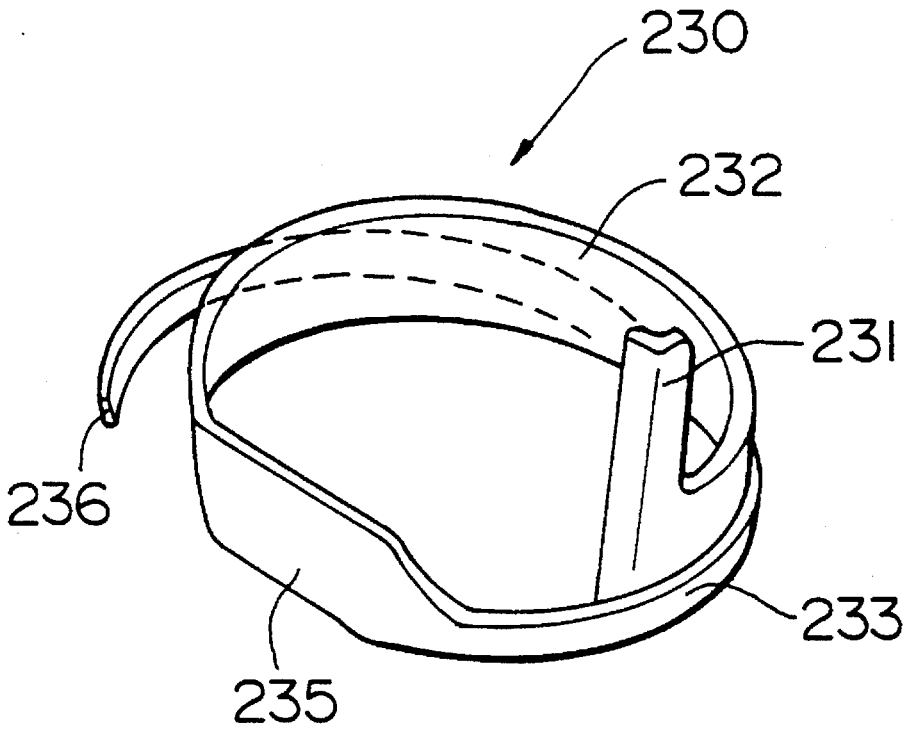
FIG. 2 is a perspective view of a pinion rotation regulating member.

The pinion rotation regulating member 230 constituting the pinion moving means, as shown in FIG. 2 and FIGS. 3A and 3B, is a sheet spring member wound through approximately 3/2 (1.5) turns of which approximately 3/4 (0.75) turn is a rotation regulating portion 232 of long axial sheet length and high spring constant and the remaining approximately 3/4 turn is a return spring portion 233 constituting urging means of short axial sheet length and low spring constant.

The regulating claw 231 which constitutes a regulating portion extending in the axial direction and which mates with the multiple projections 214 formed in the flange 213 of the pinion gear 210 is formed at one end of the rotation regulating portion 232. This regulating claw 231, as well as mating with the projections 214 of the pinion gear 210, in order to increase the rigidity of the regulating claw 231, is formed axially long and is bent radially inward into a cross-sectional L-shape (and is bar-like).

The rotation regulating portion 232 is provided with a straight portion 235 which extends vertically. This straight portion 235 is vertically slidably supported by two supporting arms 361 mounted projecting from the front surface of a center bracket 360. That is, the straight portion 235 moving vertically causes the rotation regulating portion 232 to move vertically also.

Also, a sphere 601 of the front end of a cord-shaped member 680 (for example a wire), which will be further discussed later, for transmitting the movement of the magnet switch 600, which will be further discussed later, is in engagement with the position 180° opposite the regulating claw 231 of the rotation regulating portion 232.

The end portion side of the return spring portion 233 has a large curvature of winding and one end portion 236 of the return spring portion 233 abuts the upper surface of a regulating shelf 362 mounted projecting from a front surface of a lower portion of the center bracket 360.

The operation of the pinion rotation regulating member 230 will now be explained. The cord-shaped member 680 is transmitting means for transmitting the movement of a plunger 610 of the magnet switch 600 to the regulating claw 231, and the movement of the magnet switch 600 pulls the rotation regulating portion 232 downward and causes the regulating claw 231 to engage the projections 214 on the flange 213 of the pinion gear 210. At that time, because the end portion 236 of the return spring portion 233 is in abutment with the regulating shelf 362 for position regulating, the return spring portion 233 bends. Because the regulating claw 231 is in engagement with the projections 214 on the pinion gear 210, when the pinion gear 210 starts to be rotated by way of the armature shaft 510 of the motor 500 and the planetary gear speed reduction mechanism 300, the pinion gear 210 advances along the helical spline 221 on the output shaft 220. When the pinion gear 210 abuts the ring gear 100 and the advance of the pinion gear 210 is obstructed, further rotational force of the output shaft 210 causes the pinion rotation regulating member 230 itself to bend and the pinion gear 210 rotates slightly and meshes the ring gear 100. When the pinion gear 210 advances, the regulating claw 231 disengages from the projections 214, the regulating claw 231 drops in behind the flange 213 of the pinion gear 210, the front end of the regulating claw 231 abuts the rear surface of the washer 215 and prevents the pinion gear 210 from retreating under the rotation of the ring gear 100 of the engine.

As the movement of the magnet switch 600 stops and the cord-shaped member 680 stops pulling the rotation regulating portion 232 downward, the action of the return spring portion 233 causes the rotation regulating portion 232 to return to its original position.

In this way, the pinion rotation regulating member 230, although it is one spring member, performs the three operations that are the operation of regulating the rotation of the pinion gear 210 and advancing the pinion gear 210, the operation of dropping in behind the pinion gear 210 and preventing the pinion gear 210 from retracting, and the operation of returning the rotation regulating portion 232. That is, because a plurality of operations are carried out by one part, the number of parts in the starter can be reduced and the assemblability can be improved.

Also, when the pinion rotation regulating member 230 abuts the pinion gear 210 and by means of the rotation of the output shaft 220, while moving the pinion gear 210 to the ring gear side, the pinion gear 210 abuts the ring gear 100, because the pinion rotation regulating member 230 itself bends and rotates the pinion gear 210 slightly and causes it to mesh with the ring gear, there is no production of abrasion powder and there are few parts and the construction can be made simple.

Also, the pinion rotation regulating member 230, because the projecting parts of the projections 214 of the pinion gear 210 are more numerous than the teeth of the pinion gear 210, can easily engage with the projections 214.

Because the pinion rotation regulating member 230 need only be held with the small force required to regulate the rotation of the pinion gear 210, it is possible to move it to the pinion gear side by means of the magnet switch 600, using the cord-shaped member 680, and consequently it is possible to increase the freedom with which the magnet switch 600 is disposed.

Also, the pinion rotation regulating member 230 itself can prevent the pinion gear 210 from returning when the pinion gear 210 has meshed with the ring gear 100, and the number of parts can be made small and the assembly can be simplified.

Furthermore, because the pinion rotation regulating member 230 itself integrally comprises the return spring portion 233 constituting urging means urging to the opposite side to the pinion gear 210, by switching the magnet switch 600 OFF, the pinion rotation regulating member 230 automatically moves away from the pinion gear 210 and the number of parts can be made small and the assembly can be simplified.

By part of the pinion rotation regulating member 230 having the regulating claw 231 constituting the bar-like elastic regulating portion, the pinion rotation regulating member 230 itself can reliably bend.

Also, by the washer 215 being rotatably held on the end surface of the pinion gear 210, even when the pinion gear 210 is overrun by the ring gear 100 and rotates at high speed, because the washer 215 is rotatable with respect to the pinion gear 210, the abutting portion of the regulating claw 231 constituting the regulating portion is not worn much, and the durability can be increased.

[PINION STOPPING RING 250]

The pinion stopping ring 250 is fixed in a circular groove of rectangular cross section formed around the output shaft 220. This pinion stopping ring 250 is a piece of steel of rectangular cross section processed into a circular shape. A substantially S-shaped corrugation 251 (an example of engaging means) is formed at each end, and the convex portion of one is in engagement with the concave portion of the other and the convex portion of the other is in engagement with the concave portion of the first.

[PLANETARY GEAR SPEED REDUCTION MECHANISM 300]

The planetary gear speed reduction mechanism 300, as shown in FIG. 1, is speed reducing means for transmitting in reduced speed the rotational speed of the motor 500 to the output shaft 220, which will be further discussed later, and increasing the output torque of the motor 500. The planetary gear speed reduction mechanism 300 is made up of a sun gear 310 formed on the front side outer periphery of the armature shaft 510 (discussed later) of the motor 500, a plurality of planetary gears 320 which mesh with this sun gear 310 and rotate around the circumference of the sun gear 310, a planet carrier 330 which rotatably supports these planetary gears 320 around the sun gear 310 and is formed integrally with the output shaft 220, and an internal gear 340 which is of a cylindrical shape meshing with the planetary gears 320 at the outer periphery of the planetary gears 320 and is made of resin.

[OVERRUNNING CLUTCH 350]

An overrunning clutch 350 supports the internal gear 340 rotatably in one direction only (only the direction in which it rotates under the rotation of the engine). The overrunning clutch 350 has a clutch outer 351 constituting a first cylindrical portion integrally formed at the front side of the internal gear 340, a circular clutch inner 352 constituting a second cylindrical portion formed in the rear surface of the center bracket 360 constituting a fixed side covering the front of the planetary gear speed reduction mechanism 300 and disposed facing the clutch outer 351, and a roller 353 accommodated in a roller housing portion formed inclined to the inner surface of the clutch outer 351.

[CENTER BRACKET 360]

Figure 4:
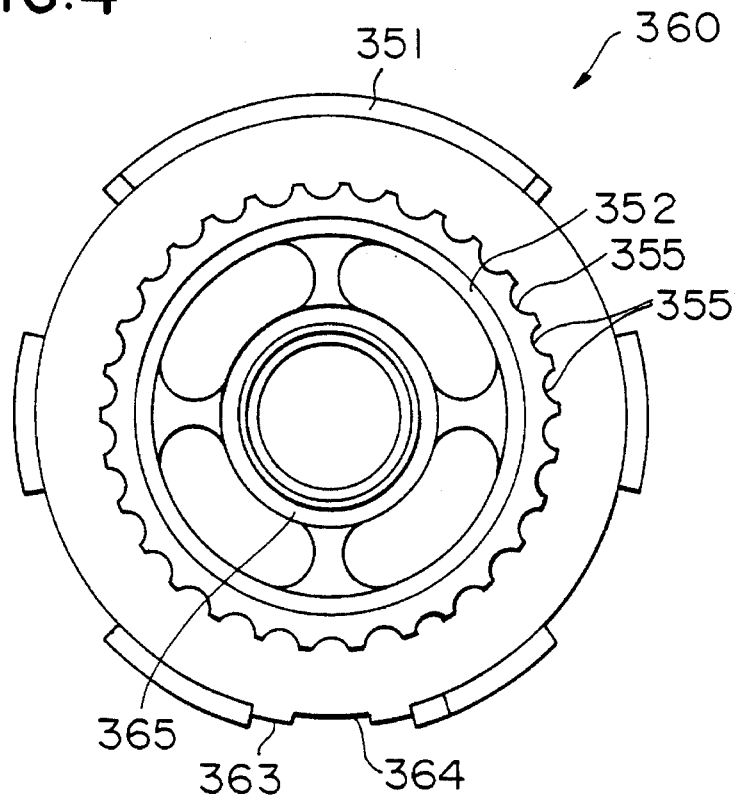
FIG. 4 is a rear view of a center bracket.
Figure 5:
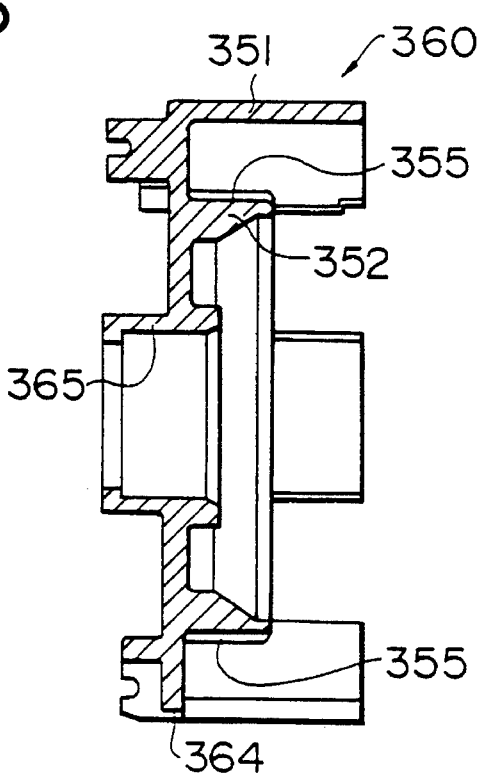
FIG. 5 is a sectional side view of a center bracket.
Figure 6:
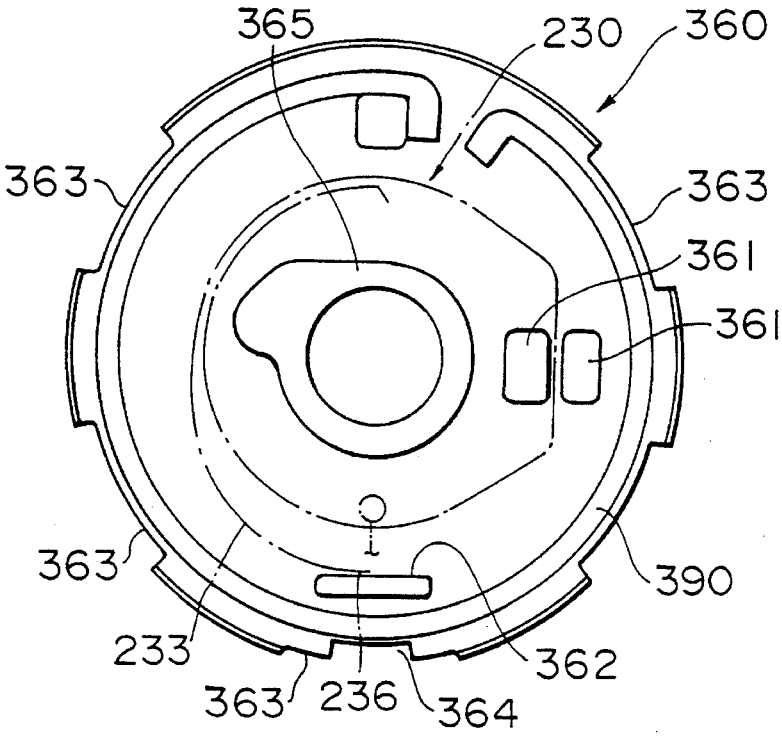
FIG. 6 is a front view of a center bracket.

The center bracket 360 is shown in FIG. 4 through FIG. 6 and is disposed inside the rear end of the housing 400. The housing 400 and the center bracket 360 are linked by a ring spring 390 having one end engaged with the housing 400 and the other end engaged with the center bracket 360 and are arranged in such a way that the rotational reaction received by a clutch inner 352 constituting the overrunning clutch 350 is absorbed by the ring spring 390 and the reaction is not directly transmitted to the housing 400.

Also, two supporting arms 361 which hold the pinion rotation regulating member 230 and a regulating shelf 362 on which the lower end of the pinion rotation regulating member 230 is loaded are mounted on the front surface of the center bracket 360. Further, a plurality of cutout portions 363 which mate with convex portions (not shown in the figures) on the inner side of the housing 400 are formed around the center bracket 360. The upper side cutout portions 363 are used also as air passages for guiding air from inside the housing 400 into a yoke 501 (discussed in detail in a cooling air passage which will be discussed later). Also, a concave portion 364 through which the cord-shaped member 680 (discussed later) passes in the axial direction is formed at the lower end of the center bracket 360.

[PLANET CARRIER 330]

A planet carrier 330 is provided at its rear end with a flange-like projecting portion 331 which extends radially in order to support the planetary gears 320. Pins 332 extending rearward are fixed to this flange-like projecting portion 331, and these pins 332 rotatably support the planetary gears 320 by way of metal bearings 333.

The planet carrier 330 has its front end rotatably supported by a housing bearing 440 fixed inside the front end of the housing 400 and a center bracket bearing 370 fixed inside an inner cylindrical portion 365 of the center bracket 360.

[HOUSING 400]

The housing 400 supports the output shaft 220 with the housing bearing 440 fixed in the front end of the housing 400 and also is provided with a water barrier wall 460 which in order to minimize the incursion of rainwater and the like through the opening portion 410 minimizes the gap at the lower part of the opening portion 410 between the outer diameter of the pinion gear 210 and the housing 400. Also, two slide grooves (not Shown) extending axially are provided at the lower part of the front end of the housing 400, and a shutter 420 is disposed in these slide grooves.

[SHUTTER 420]

The shutter 420 consisting of a resinous member (for example nylon) is mounted on the output shaft 220 and comprises a ring body 421 sandwiched between the return spring 240 and the pinion gear 210 and a water-barrier portion 422 which opens and closes an opening portion 410 in the housing 400. The operation of the shutter 420 is such that when the starter starts to operate and the pinion gear 210 shifts forward along the output shaft 220 the ring body 421 shifts forward together with the pinion gear 210. When this happens, the water-barrier portion 422 integral with the ring body 421 shifts forward and opens the opening portion 410 of the housing 400. When the starter stops operating and the pinion gear 210 shifts backward along the output shaft 220, the ring body 421 also shifts backward together with the pinion gear 210. When this happens, the water-barrier portion 422 integral with the ring body 421 also shifts backward and closes the opening portion 410 of the housing 400. As a result, the shutter 420, which constitutes opening and closing means, by means of the water-barrier portion 422 prevents rainwater and the like which is splashed by the centrifugal force of the ring gear 100 from getting inside the housing 400 when the starter is not operating.

[MOTOR 500]

The motor 500 is enclosed by a yoke 501, a motor spacer wall 800, and a brush holding member 900 which will be discussed later. The motor spacer wall 800 houses the planetary gear speed reduction mechanism 300 between itself and the center bracket 360, and also fulfills the role of preventing lubricating oil inside the planetary gear speed reduction mechanism 300 from getting into the motor 500.

The motor 500, as shown in FIG. 1, is made up of an armature 540 comprising the armature shaft 510, an armature core 520 and armature coils 530 which are mounted on and rotate integrally with this armature shaft 510. To rotate the armature 540, permanent magnet fixed poles 550 are mounted around the inside of the yoke 501.

[ARMATURE COILS 530]

For the armature coils 530, in this embodiment, multiple (for example 25) upper layer coil bars 531 and the same number of lower layer coil bars 532 as these upper layer coil bars 531 are used, and two-layer-winding coils wherein the respective upper layer coil bars 531 and the lower layer coil bars 532 are stacked in the radial direction are employed. The upper layer coil bars 531 and lower layer coil bars 532 are paired, and the ends of the upper layer coil bars 531 and the ends of the lower layer coil bars 532 are electrically connected to constitute ring-shaped coils.

[UPPER LAYER COIL BARS 531]

Figure 7:
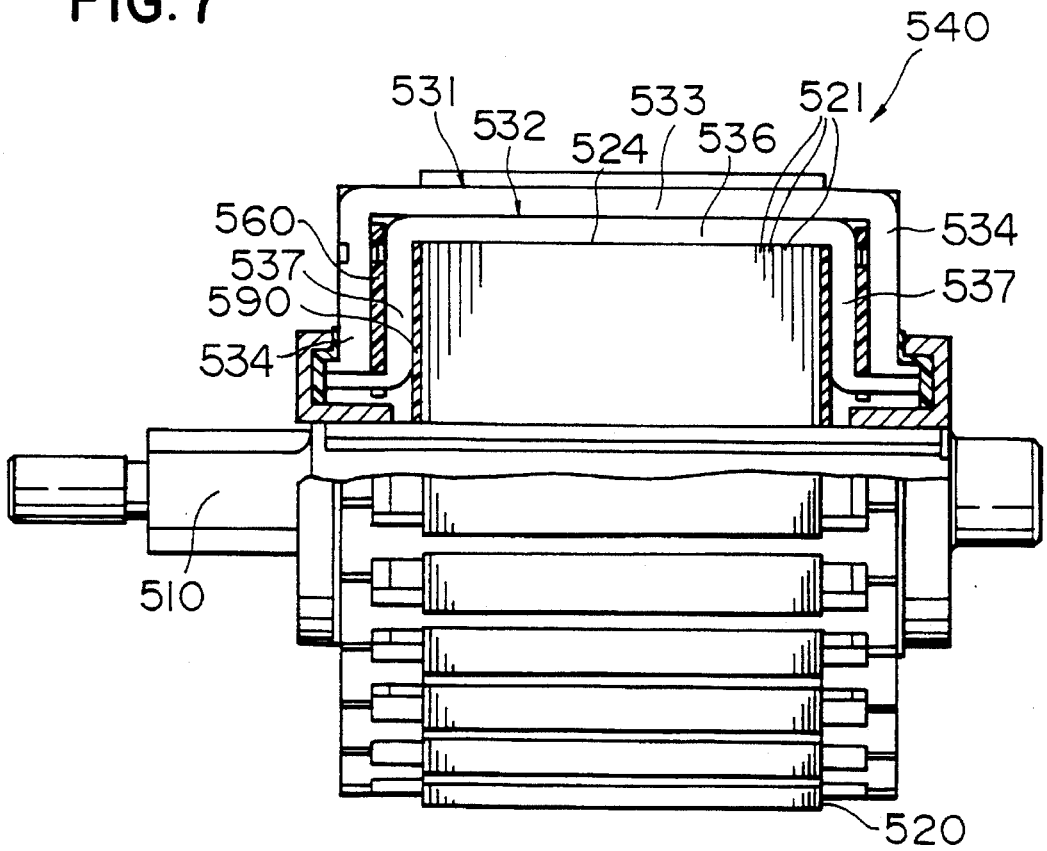
FIG. 7 is a sectional side view of an armature.

The upper layer coil bars 531, as shown in FIG. 7, are made of a material having excellent electrical conductivity (for example copper), and are each provided with an upper layer coil arm 533 which extends axially in parallel with the fixed poles 550 and is held in the outer sides of slots 524 and two upper layer coil ends 534 which are bent inward from both ends of the upper layer coil arm 533 and extend in a direction orthogonal to the axial direction of the armature shaft 510. The upper layer coil arm 533 and the two upper layer coil ends 534 may be a member integrally molded by cold casting, may be a member shaped by bending in a press into a U-shape, or may be a member formed by joining an upper layer coil arm 533 and two upper layer coil ends 534 made as separate parts by a joining method such as welding.

[LOWER COIL BARS 532]

The lower coil bars 532, like the upper coil bars 531, are made from a material having excellent electrical conductivity (for example copper), and each comprise a lower layer coil arm 536 which extends axially in parallel with respect to the fixed poles 550 and is held in the inner sides of slots 524 and two lower layer coil ends 537 which are bent inward from the ends of this lower layer coil arm 536 and extend orthogonally to the axial direction of the armature shaft 510. The lower layer coil arm 536 and the two lower layer coil ends 537, like the upper layer coil bar 531, may be a member integrally molded by cold casting, may be a member shaped by bending in a press into a U-shape, or may be a member formed by joining a lower layer coil arm 536 and 2 lower layer coil ends 537 made as separate parts by a joining method such as welding.

Insulation between the upper layer coil ends 534 and the lower layer coil ends 537 is secured by insulating spacers 560, and insulation between the lower layer coil ends 537 and the armature core 520 is secured by an insulating ring 590 made of resin (for example nylon or phenol resin).

[YOKE 501]

Figure 8:
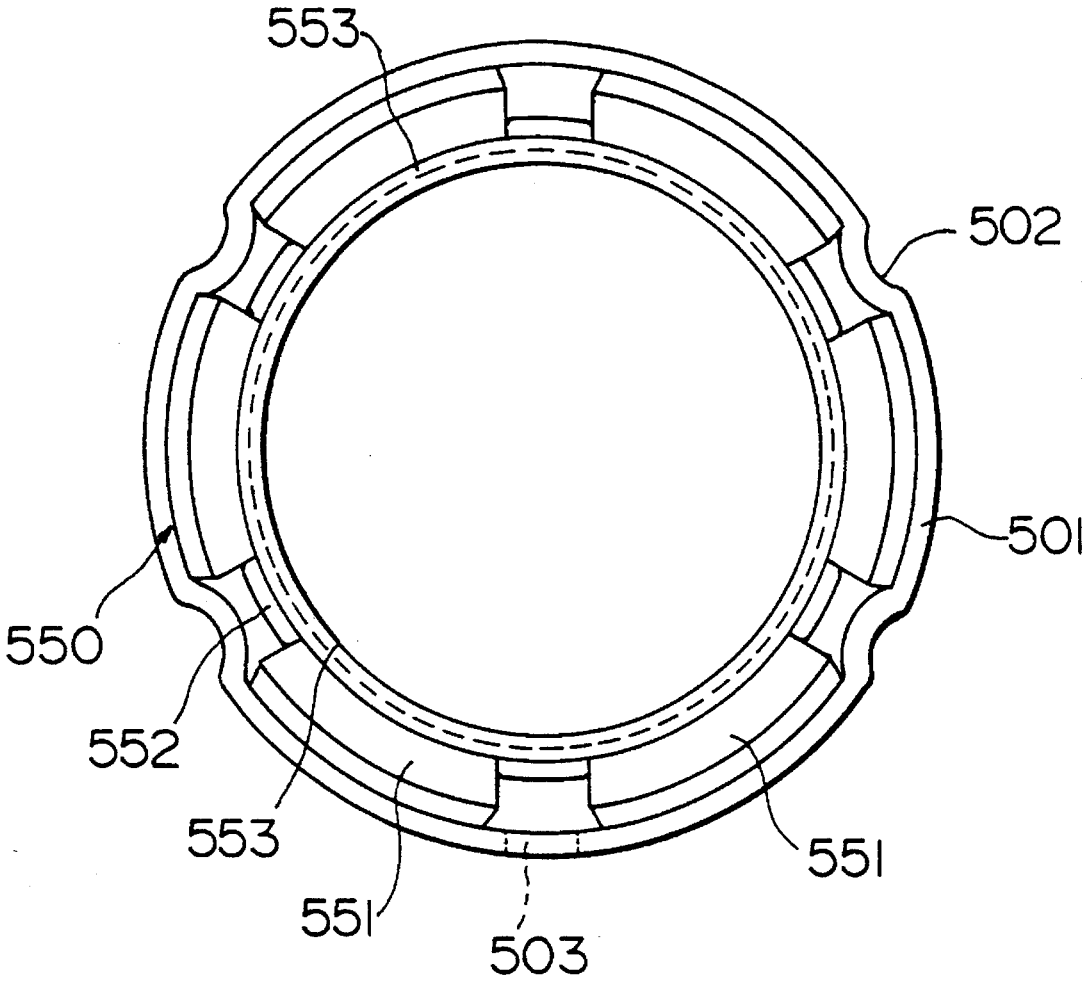
FIG. 8 is a front view of a yoke.

The yoke 501, as shown in FIG. 8, is a cylindrical body formed by rolling a steel plate, and around it are formed a plurality of concave grooves 502 extending axially and sunk toward the inner circumference. These concave grooves 502, as well as disposing through bolts, are used for positioning fixed poles 550 around the inner circumference of the yoke 501.

[FIXED POLES 550]

In this embodiment permanent magnets are used for the fixed poles 550 and, as shown in FIG. 8, they comprise a plurality of (for example 6) main poles 551 and inter-pole poles 552 disposed between these main poles 551. Field coils which generate magnetic force by electrical current flow may be used instead of permanent magnets for the fixed poles 550.

The main poles 551 are positioned by the ends of the inner sides of channel grooves 502 in the above-mentioned yoke 501, and are fixed in the yoke 501 by fixing sleeves 553 disposed around the inside of the fixed poles 550 with the inter-pole poles 552 disposed between the main poles 551.

[MAGNET SWITCH 600]

Figure 9:
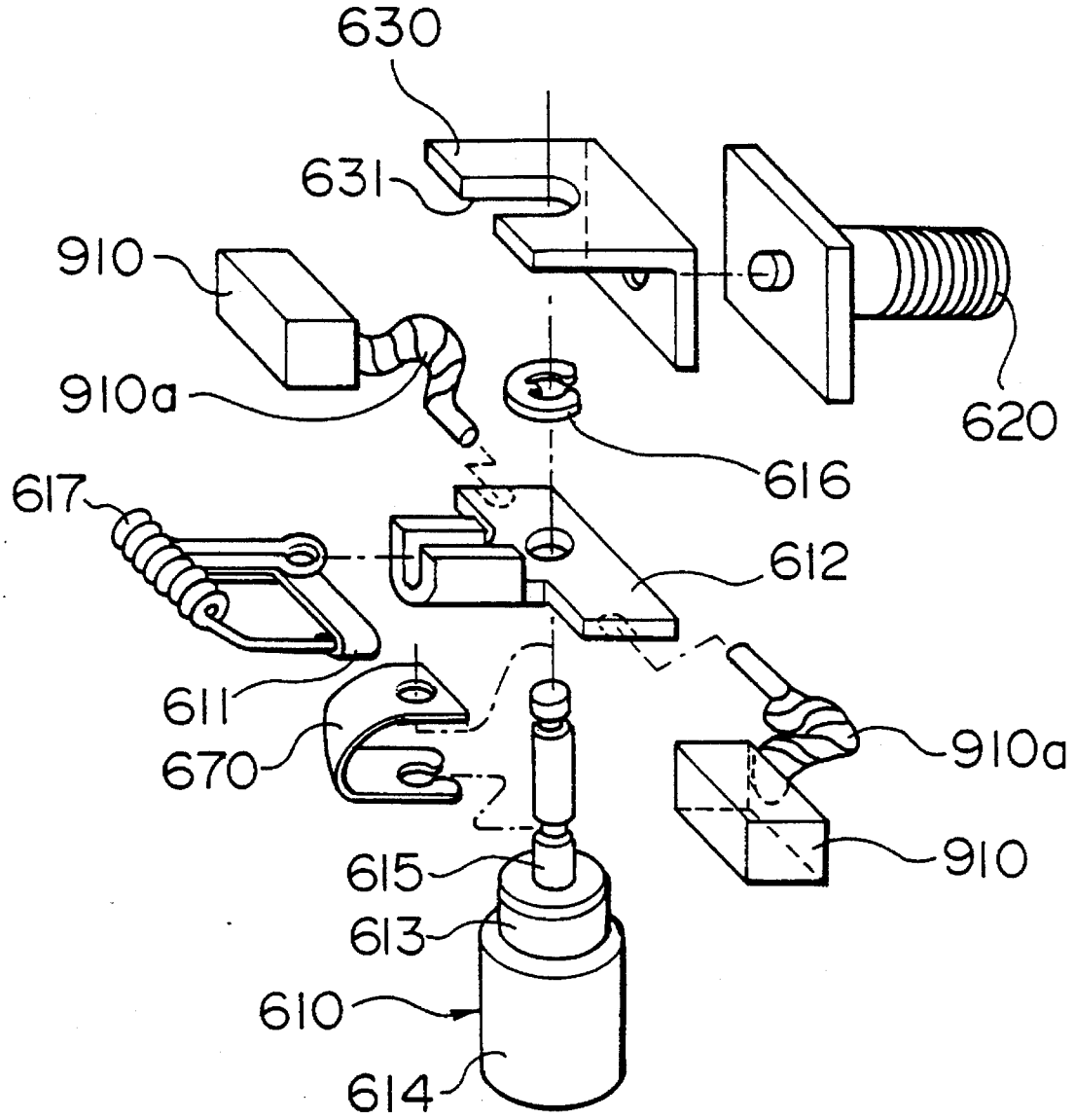
FIG. 9 is an exploded perspective view of a plunger and contact points of a magnet switch.
Figure 10:
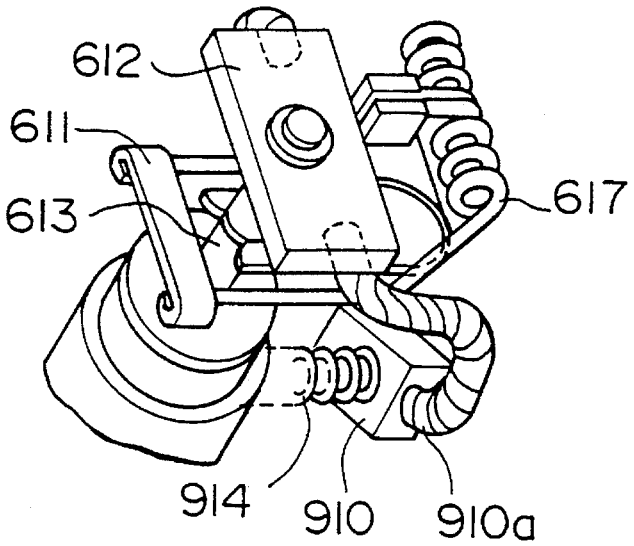
FIG. 10 is a perspective view showing a plunger of a magnet switch.

The magnet switch 600, as shown in FIG. 1, FIG. 9 and FIG. 10, is held in a brush holder 900 which will be discussed later, is disposed inside the end frame 700 formed on the opposite side of the starter motor from the pinion 210, and is fixed so as to be substantially orthogonal to the armature shaft 510.

In the magnet switch 600, electrical current drives a plunger 610 upward, and two contacts (a lower movable contact 611 and an upper movable contact 612) which move together with the plunger 610 are sequentially caused to abut with the head portion 621 of a terminal bolt 620 and an abutting portion 631 of a fixed contact 630. A battery cable not shown in the figures is connected to the terminal bolt 620.

The magnet switch 600 is structured inside a magnet switch cover 640 which is cylindrical and has a bottom and is made from magnetic parts (for example made of iron). The magnet switch cover 640 is for example a pliable steel plate press-formed into a cup shape, and in the center of the bottom of the magnet switch cover 640 there is a hole 641 through which the plunger 610 passes movably in the vertical direction. Also, the upper opening of the magnet switch cover 640 is closed off by a stationary core 642 made of a magnetic body (for example made of iron).

The stationary core 642 consists of an upper large diameter portion 643, a lower middle diameter portion 644, and a still lower small diameter portion 645, and the stationary core 642 is fixed in the upper opening of the magnet switch cover 640 by the outer periphery of the large diameter portion 643 being caulked to the inner side of the upper end of the magnet switch cover 640. The upper end of an attracting coil 650 is fitted around the middle diameter portion 644. The upper end of a compression coil spring 660 which urges the plunger 610 downward is fitted around the periphery of the small diameter portion 645 of the stationary core 642.

The attracting coil 650 is attracting means which generates magnetism when a current flows through it and attracts the plunger 610, and the attracting coil 650 is provided with a sleeve 651 which has its upper end fitted to the middle diameter portion 644 of the stationary core 642 and covers the plunger 610 slidably in the vertical direction. This sleeve 651 is made by rolling up a non-magnetic thin plate (for example copper plate, brass, stainless steel), and insulating washers 652 made of resin or the like are provided at the upper and lower ends of this sleeve 651. Around the sleeve 651 between these two insulating washers 652 there is wound a thin insulating film (not shown in the drawings) made of resin (for example cellophane, nylon film) or paper, and around that insulating film is wound a predetermined number of turns of a thin enamel wire, whereby the attracting coil 650 is constituted.

The plunger 610 is made of a magnetic metal (for example iron) and has a substantially cylindrical shape comprising an upper small diameter portion 613 and a lower large diameter portion 614. The lower end of the compression coil spring 660 is fitted to the small diameter portion 613, and the large diameter portion 614, which is relatively long in the axial direction, is held slidably vertically in the sleeve 651.

A plunger shaft 615 extending upward from the plunger 610 is fixed to the upper end of the plunger 610. This plunger shaft 615 projects upward through a through hole provided in the stationary core 642. An upper movable contact 612 is fitted around the plunger shaft 615 above the stationary core 642 slidably vertically along the plunger shaft 615. This upper movable contact 612, as shown in FIG. 9, is limited by a stopping ring 616 fitted to the upper end of the plunger shaft 615 so that it does not move upward of the upper end of the plunger shaft 615. As a result, the upper movable contact 612 is vertically slidable along the plunger shaft 615 between the stopping ring 616 and the stationary core 642. The upper movable contact 612 is urged upward at all times by a contact pressure spring 670 consisting of a sheet plate spring fitted to the plunger shaft 615.

The upper movable contact 612 is made of a metal such as copper having excellent conductivity, and when both ends of the upper movable contact 612 move upward they abut with the two abutting portions 631 of the fixed contact 630. Lead wires 910*a* of a pair of brushes 910 are electrically and mechanically fixed to the upper movable contact 612 by caulking or welding or the like. Also, the end portion of a resistor member 617 constituting a plurality of (in this embodiment, two) limiting means is inserted and electrically and mechanically fixed in a groove portion of the upper movable contact 612.

The lead wires 910*a* of the brushes 910 are electrically and mechanically fixed to the upper movable contact 612 by caulking or welding, but the upper movable contact 612 and the lead wires 910*a* of the brushes 910 may alternatively be formed integrally.

The resistor member 617 is for rotating the motor 500 at low speed when the starter starts to operate, and consists of a metal wire of high resistance wound through several turns. The lower movable contact 611 located below the head portion 621 of the terminal bolt 620 is fixed by caulking or the like to the other end of the resistor member 617.

The lower movable contact 611 is made of a metal such as copper having excellent conductivity, and when the magnet switch 600 stops and the plunger 610 is in its downward position abuts the upper surface of the stationary core 642, when the resistor member 617 moves upward along with the movement of the plunger shaft 615, before the upper movable contact 612 abuts the abutting portion 631 of the fixed contact 630 it abuts the head portion 621 of the terminal bolt 620.

The lower surface of the plunger 610 is provided with a recess portion 682 which accommodates a ball or sphere 681 provided at the rear end of the cord-shaped member 680 constituting the link means (for example a wire). A female thread 683 is formed on the inner wall of this recess portion 682. A fixing screw 684 which fixes the sphere 681 in the recess portion 682 is screwed into this female thread 683. This fixing screw 684 is also used to perform adjustment of the length of the cord-shaped member 680, by adjusting the extent to which the fixing screw 684 is screwed into the female thread 683. The length of the cord-shaped member 680 is adjusted so that, when the plunger shaft 615 moves upward and the lower movable contact 611 abuts the terminal bolt 620, the regulating claw 231 of the pinion rotation regulating member 230 mates with the projections 214 of the outer periphery of the pinion gear 210. The female thread 683 and the fixing screw 684 constitute an adjusting mechanism.

With such a construction, because the magnet switch 600 is disposed apart from the pinion 210 or oppositely from the motor 500, the distance between the plunger 610 of the magnet switch 600 and the pinion rotation regulating member 230 is lengthened so that the cord-shaped member 680 constituting the link means is lengthened. As a result, the impact force produced when the pinion 210 meshes the ring gear 100 is absorbed by this long cord-shaped member 680 and can be prevented from being directly transmitted to the plunger 610. Consequently, there is no vibration of the plunger 610, and the lower movable contact 611 can be reliably prevented from moving away from the terminal bolt 620.

Further, because the pinion rotation regulating member 230 is moved to the pinion gear 210 side via the cord-shaped member 680, link mechanisms and levers which are rigid to be mechanically strong are not necessary and the number of parts can be reduced, and also even if the pinion gear 210 fails to move away from the ring gear 100, bending in the cord-shaped member 680 itself causes the plunger 610 to return to its original position, and the upper movable contact 612 can move away from the fixed contact 630.

Also, because all that is necessary is to cause the regulating claw 231 of the pinion rotation regulating member 230 to engage with the projections 214 on the pinion gear 210, this regulating claw 231 can be reliably moved by the cord-shaped member 680.

By making the cord-shaped member 680 a wire which is flexible, the durability can be increased.

Also, by disposing the adjusting mechanism consisting of the female thread 683 and the fixing screw 684 between the plunger 610 and the cord-shaped member 680 and screwing the fixing screw 684 into the female thread 683, the length of the cord-shaped member 680 can be easily adjusted.

Also, because the lead wires 910*a* of the brushes 910 are directly connected to the upper movable contact 612, heat generated at the brushes 910 is efficiently radiated via the lead wires 910*a*, the upper movable contact 612 and the terminal bolt 620 from the battery cable connected to the terminal bolt 620 and positioned outside the starter, and increases in the life of the brushes 910 can be attempted.

Furthermore, because the plunger shaft 615 of the magnet switch 600 is disposed substantially orthogonally to the motor axis, compared to a case wherein the plunger shaft 615 of the magnet switch 600 is disposed axially, the axial direction dimension of the starter can be shortened and the stroke through which the plunger shaft 615 is required to pull the cord-shaped member 680 can be set small, and further downsizing of the magnet switch 600 can be attained.

Furthermore, because the plunger 615 of the magnet switch 600 is disposed orthogonally with respect to the axial direction of the armature shaft 510, only the diametral direction length of the magnet switch 600 adds to the axial direction length of the overall starter, and the build of the whole starter is not made large.

Furthermore, because the magnet switch 600 is housed inside the end frame 700, it does not readily suffer damage from water and the like which has entered through the opening 410 in the housing 400.

[END FRAME 700]

Figure 11:
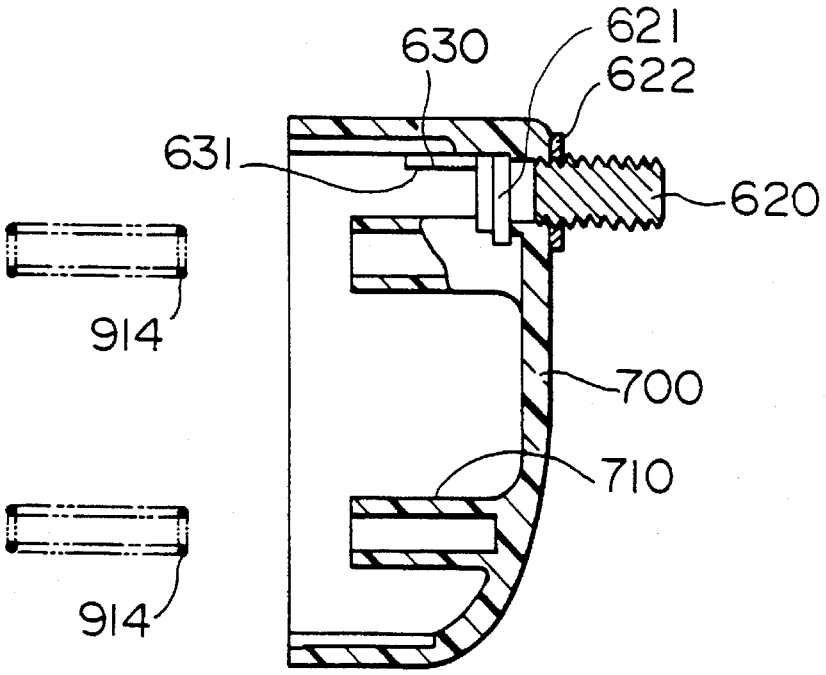
FIG. 11 is a sectional view of an end frame and a brush spring.

The end frame 700, as shown in FIG. 11, is a magnet switch cover made of resin (for example phenol resin), and accommodates the magnet switch 600.

Spring holding pillars 710 which hold compression coil springs 914 which urge the brushes 910 forward are mounted projecting from the rear surface of the end frame 700 in correspondence to the positions of the brushes 910.

Also, the compression coil springs 914, as shown in FIG. 1, are disposed radially outward with respect to the axial direction of the plunger 610 of the magnet switch 600.

The terminal bolt 620 is a steel bolt which passes through the end frame 700 from the inside and projects from the rear of the end frame 700 and has at its front end a head portion 621 which abuts the inner surface of the end frame 700. The terminal bolt 620 is fixed to the end frame 700 by a caulking washer 622 being attached to the terminal bolt 620 projecting rearward of the end frame 700. A copper fixed contact 630 is fixed to the front end of the terminal bolt 620 by caulking. The fixed contact 630 has one or a plurality of (in this embodiment, two) abutting portions 631 positioned at the top end of the inside of the end frame 700, and these abutting portions 631 are mounted so that the upper surface of the upper movable contact 612 which is moved up and down by the operation of the magnet switch 600 can abut with the lower surfaces of the abutting portions 631.

Further, the spring length of the compression coil springs 914 can use the radial direction length of the magnet switch 600, a suitable spring stress and load can be set, and the life of the compression coil springs 914 can be greatly increased.

[THE BRUSH HOLDER 900]

The brush holder 900, as well as the roles of separating the inside of the yoke 501 and the inside of the end frame 700 and rotatably supporting the rear end of the armature shaft 510 by way of the brush holder bearing 564, also fulfills the role of a brush holder, the role of holding the magnet switch 600, and the role of holding a pulley 690 which guides the cord-shaped member 680. The brush holder 900 has a hole portion not shown in the drawings through which the cord-shaped member 680 passes.

Also, in a pulley 690 constituting a support member to convert the extending direction of the cord-shaped member 680, instead of the adjusting mechanism of the length of the cord-shaped member 680 by means of a screw member inside the plunger 610 as described above, the axial position of this pulley 690 can be adjusted so as to adjust the positions of the both of the end portions of the cord-shaped member 680 to obtain the same effect. The cord-shaped member 680 can not only be fixed onto the end portion of the plunger 610 but be integrally formed with the plunger 610.

Figure 12:
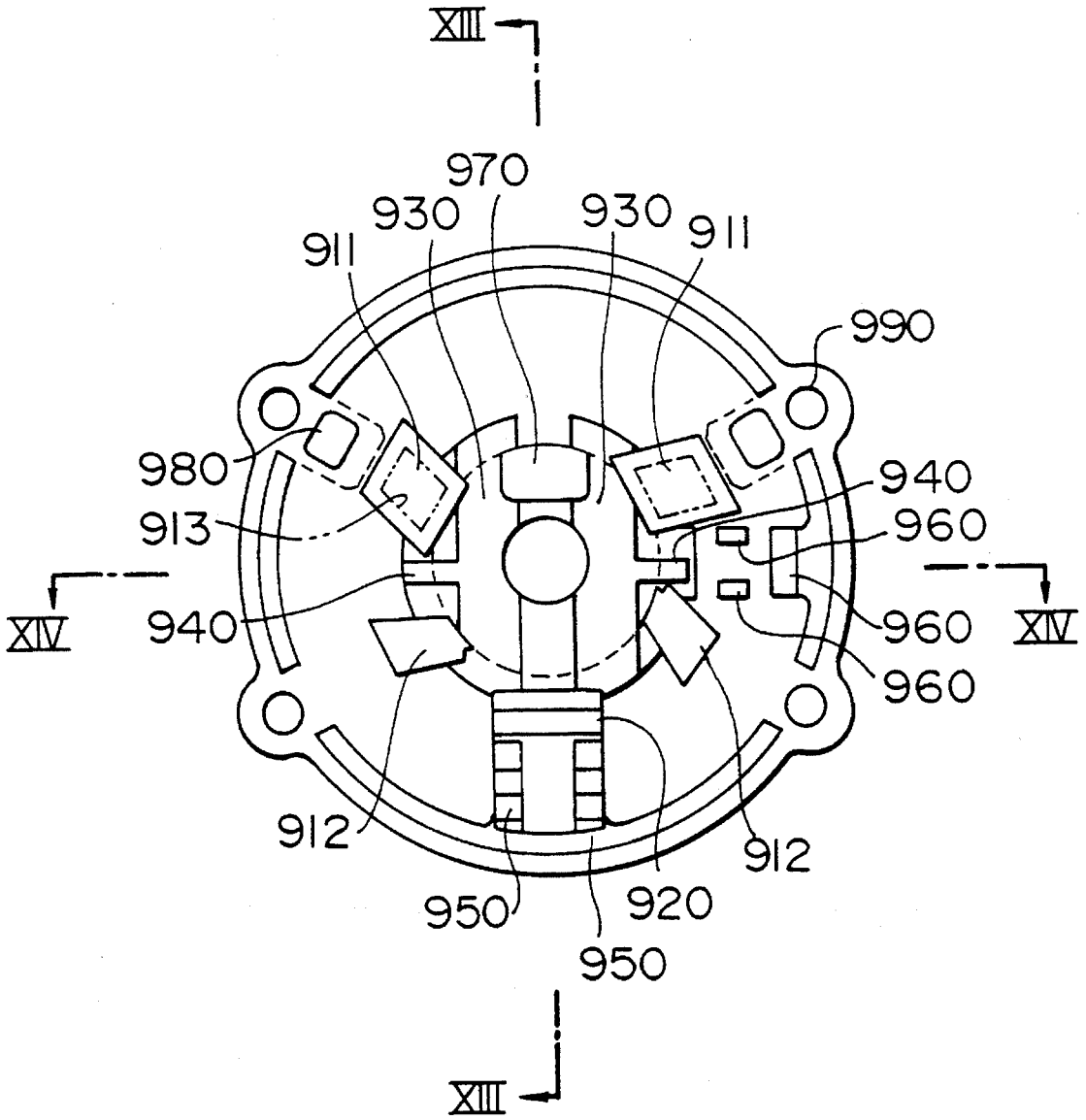
FIG. 12 is a front view of a brush holder.
Figure 13:
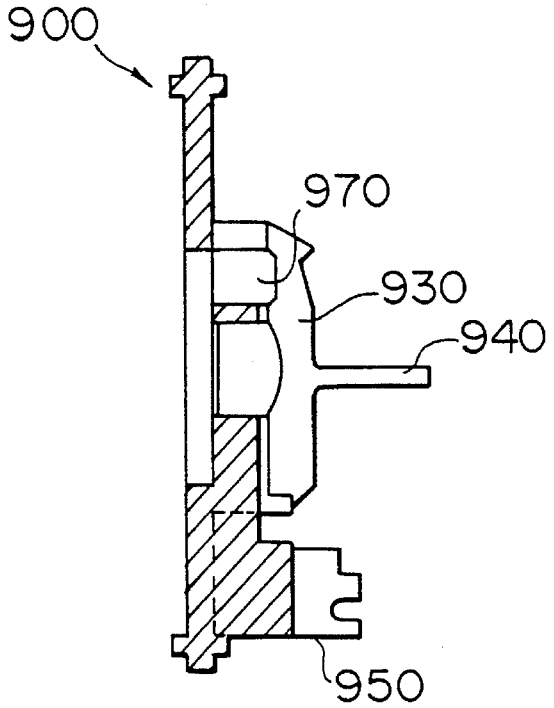
FIG. 13 is a sectional view taken along the line XIII—XIII in FIG. 12.
Figure 14:
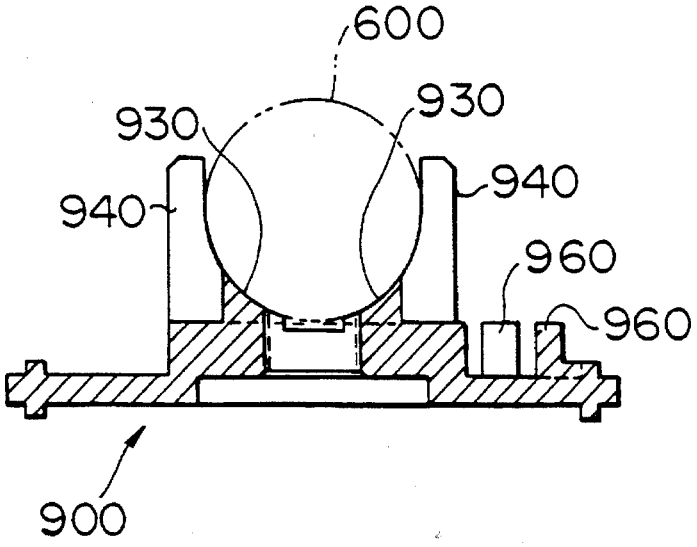
FIG. 14 is a sectional view taken along the line XIV—XIV in FIG. 12.

The brush holder 900 is a spacing wall made of a metal such as aluminum molded by a casting method and, as shown in FIG. 12 through FIG. 14, has a plurality of (in this embodiment, two upper and two lower) brush holding holes 911, 912 which hold the brushes 910 in the axial direction. The upper brush holding holes 911 are holes which hold brushes 910 which receive a plus voltage, and these upper brush holding holes 911 hold the brushes 910 by way of resin (for example nylon, phenol resin) insulating cylinders 913 (FIG. 13 is a cross-section taken along XIII—XIII in FIG. 12, and FIG. 14 is a cross-section taken along XIV—XIV in FIG. 12). The lower brush holding holes 912 are holes which hold brushes 910 connected to the ground, and these lower brush holding holes 912 hold the respective brushes 910 directly therein.

In this way, by holding the brushes 910 by means of the brush holder 900, there is no need to provide the starter with independent brush holders. As a result, the number of parts in the starter can be reduced and assembly man-hours can be reduced.

The front end surfaces of brushes 910 are urged against the rear surfaces of the upper layer coil ends 534 at the rear ends of the armature coils 530 by the compression coil springs 914.

The lead wires 910*a* of the upper brushes 910 are electrically and mechanically joined by a joining method such as welding or caulking to the upper movable contact 612 which is moved by the magnet switch 600. The lead wires 910*a* of the lower brushes 910 are caulked and thereby electrically and mechanically joined to a concave portion 920 formed in the rear surface of the brush holder 900. In this embodiment a pair of lower brushes 910 are provided, one lead wire 910*a* is connected to the pair of lower brushes 910, and the middle of the lead wire 910*a* is caulked in the concave portion 920 formed in the rear surface of the brush holder 900.

Two seats 930 with which the front side of the magnet switch 600 abuts and two fixing pillars 940 which hold the periphery of the magnet switch 600 are formed on the rear side of the brush holder 900.

The seats 930 are shaped to match the external shape of the magnet switch 600 in order to abut with the magnet switch 600, which has a cylindrical exterior. The two fixing pillars 940, with the magnet switch 600 in abutment with the seats 930, by having their rear ends caulked to the inner side, hold the magnet switch 600.

A pulley holding portion 950 which holds a pulley 690 which converts the direction of movement of the cord-shaped member 680 from the vertical direction of the magnet switch 600 into the axial direction thereof is formed on the lower side of the rear side of the brush holder 900.

[OPERATION OF FIRST EMBODIMENT]

Next, the operation of the starter described above will be explained with reference to the electrical circuit diagrams shown in FIGS. 15A through 15C.

Figure 15A:
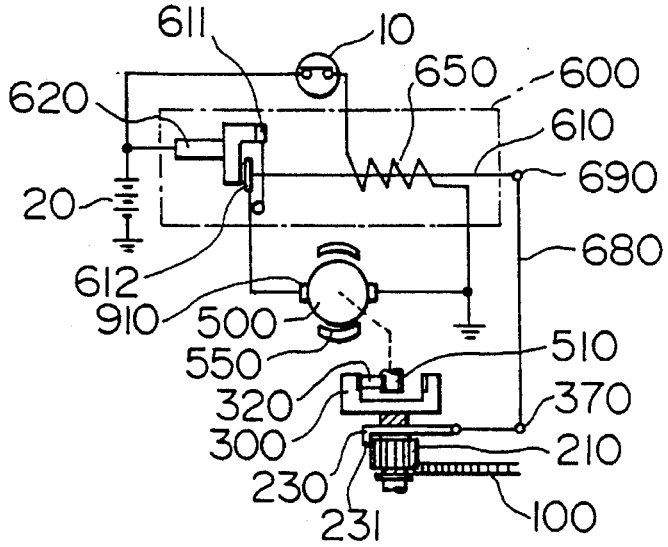
FIGS. 15A through 15C are electrical circuit diagrams in which the operating state of a pinion is shown.

When a key switch 10 is set to the start position by a driver as shown in FIG. 15A, electricity flows from a battery 20 to the attracting coil 650 of the magnet switch 600. When current flows through the attracting coil 650, the plunger 610 is pulled by the magnetic force produced by the attracting coil 650, and the plunger 610 ascends from its lower position to its upper position.

When the plunger 610 starts to ascend, together with the ascent of the plunger shaft 615 the upper movable contact 612 and the lower movable contact 611 ascend, and the rear end of the cord-shaped member 680 also ascends. When the rear end of the cord-shaped member 680 ascends, the front end of the cord-shaped member 680 is pulled down, and the pinion rotation regulating member 230 descends. When the descent of the pinion rotation regulating member 230 causes the regulating claw 231 to mate with the projections 214 on the periphery of the pinion gear 210, the lower movable contact 611 abuts the head portion 621 of the terminal bolt 620. The voltage of the battery 20 is applied to the terminal bolt 620, and the voltage of the terminal bolt 620 is transmitted through the lower movable contact 611, the resistor member 617, the upper movable contact 612, the lead wires 910*a* to the upper brushes 910. That is, the low voltage passing through the resistor member 617 is transmitted through the upper brushes 910 to the armature coils 530. Because the lower brushes 910 are constantly grounded through the brush holder 900, a current flows at low voltage through the armature coils 530 constituted in coil form by the paired upper layer coil bars 531 and lower layer coil bars 532. When this happens, the armature coils 530 generate a relatively weak magnetic force, this magnetic force acts on (attracts or repels) the magnetic force of the fixed poles 550, and the armature 540 rotates at low speed.

When the armature shaft 510 rotates, the planetary gears 320 of the planetary gear speed reduction mechanism 300 are rotationally driven by the sun gear 310 on the front end of the armature shaft 510. When the planetary gears 320 exert a rotational torque through the planet carrier 330 on the internal gear 340 in the direction which rotationally drives the ring gear 100, the rotation of the internal gear 340 is limited by the operation of the overrunning clutch 350. That is, because the internal gear 340 does not rotate, the rotation of the planetary gears 320 causes the planet carrier 330 to rotate at low speed. When the planet carrier 330 rotates, the pinion gear 210 also rotates, but because the pinion gear 210 has its rotation limited by the pinion rotation regulating member 230 the pinion gear 210 advances along the helical spline 221 on the output shaft 220.

Together with the advance of the pinion gear 210, the shutter 420 also advances, and opens the opening portion 410 of the housing 400. The advance of the pinion gear 210 causes the pinion gear 210 to mesh completely with the ring gear 100 and then abut with the pinion stopping ring 250. Also, when the pinion gear 210 advances, the regulating claw 231 disengages from the projections 214 of the pinion gear 210 and after that the front end of the regulating claw 231 drops to the rear side of the washer 215 disposed on the rear side of the pinion gear 210.

Figure 15B:
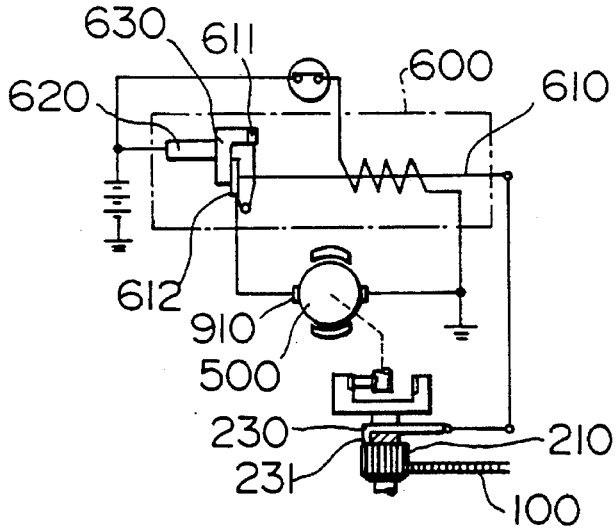

With the pinion gear 210 advanced, the upper movable contact 612 abuts the abutting portion 631 of the fixed contact 630 as shown in FIG. 15B. When this happens, the battery voltage of the terminal bolt 620 is directly transmitted through the upper movable contact 612 and the lead wires 910*a* to the upper brushes 910. That is, a high current flows through the armature coils 530 consisting of the upper coil bars 531 and the lower coil bars 532, the armature coils 530 generate a strong magnetic force and the armature 540 rotates at rated speed.

The rotation of the armature shaft 510 is slowed and has its rotational torque increased by the planetary gear speed reduction mechanism 300 and rotationally drives the planet carrier 330. At this time, the front end of the pinion gear 210 abuts the pinion stopping ring 250 and the pinion gear 210 rotates integrally with the planet carrier 330. Because the pinion gear 210 is meshing with the ring gear 100 of the engine, the pinion gear 210 rotationally drives the ring gear 100 and rotationally drives the output shaft of the engine.

Next, when the engine starts and the ring gear 100 of the engine rotates faster than the rotation of the pinion gear 210, the action of the helical spline creates a force tending to retract the pinion gear 210. However, the regulating claw 231 which has dropped to behind the pinion gear 210 prevents the pinion gear 210 from retracting, prevents early disengagement of the pinion gear 210, and enables the engine to be started surely.

When the engine starting causes the ring gear 100 to rotate faster than the rotation of the pinion gear 210, the rotation of the ring gear 100 rotationally drives the pinion gear 210. When this happens, the rotational torque transmitted from the ring gear 100 to the pinion gear 210 is transmitted through the planet carrier 330 to the pins 332 which support the planetary gears 320. That is, the planetary gears 320 are driven by the planet carrier 330. When this happens, because a torque rotationally opposite to that during engine starting is exerted on the internal gear 340, the overrunning clutch 350 allows the rotation of the ring gear 100. That is, when a torque rotationally opposite to that during engine starting is exerted on the internal gear 340, the roller 353 of the overrunning clutch 350 detaches to outside the concave portion 355 of the clutch inner 352 and rotation of the internal gear 340 becomes possible.

In other words, the relative rotation with which the ring gear 100 of the engine rotationally drives the pinion gear 210 when the engine starts is absorbed by the overrunning clutch 350, and the armature 540 is never rotationally driven by the engine.

Figure 15C:
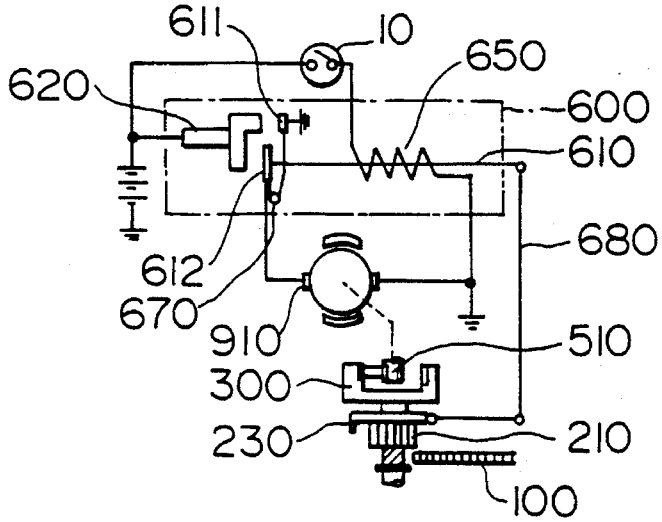

When the engine starts, the driver releases the key switch 10 from the start position as shown in FIG. 15C and the flow of current to the attracting coil 650 of the magnet switch 600 is stopped. When the flow of current to the attracting coil 650 stops, the plunger 610 is returned downward by the action of the compression coil spring 660.

When this happens, the upper movable contact 612 moves away from the abutting portion 631 of the fixed contact 630, and after that the lower movable contact 611 also moves away from the head portion 621 of the terminal bolt 620, and the flow of current to the upper brushes 910 is stopped.

When the plunger 610 is returned downward, the action of the return spring portion 236 of the pinion rotation regulating member 230 causes the pinion rotation regulating member 230 to return upward, and the regulating claw 231 moves away from the rear of the pinion gear 210. When this happens, the pinion gear 210 is returned rearward by the action of the return spring 240, the meshing of the pinion gear 210 with the ring gear 100 of the engine is disengaged, and the rear end of the pinion gear 210 abuts the flange-like projecting portion 222 of the output shaft 220. That is, the pinion gear 210 is returned to the position it was in before the starter was started.

Also, the plunger 610 being returned downward causes the lower movable contact 611 to abut with the upper surface of the stationary core 642 of the magnet switch 600, and the lead wires 910*a* of the upper brushes 910 conduct electrical current in the order the upper movable contact 612, the resistor member 617, the lower movable contact 611, the stationary core 642, the magnet switch cover 640 and the brush holder 900. In other words, the upper brushes 910 and the lower brushes 910 short-circuit through the brush holder 900. Meanwhile, inertial rotation of the armature 540 generates an electromotive force in the armature coils 530. Because this electromotive force is short-circuited through the upper brushes 910, the brush holder 900 and the lower brushes 910, a braking force is exerted on the inertial rotation of the armature 540. As a result, the armature 540 rapidly stops.

[ADVANTAGES OF FIRST EMBODIMENT]

According to the starter of the first embodiment, the magnet switch 600 is disposed apart from the pinion 210 so the distance between the plunger 610 of the magnet switch 600 and the pinion rotation regulating member 230 can be lengthened, and the cord-shaped member 680 constituting the link means can be lengthened. Therefore, the impact force generated when the pinion 210 meshes the ring gear 100 can be absorbed by this long cord-shaped member 680, and prevented from being transmitted directly to the plunger 610. Thus vibration of the plunger 610 is eliminated, and the lower movable contact 611 can be reliably prevented from moving away from the terminal bolt 620.

Because the pinion gear 210 is moved to the ring gear side via the cord-shaped member 680 and via the pinion rotation regulating member 230, rigid link mechanism such as levers and the like are not necessary and the number of parts can be reduced, and also even if the pinion gear 210 fails to move away from the ring gear 100 when the pinion gear 210 meshes the ring gear 100, bending in the cord-shaped member 680 itself causes the plunger 610 to return to its original position, and the movable contacts 611 and 612 can move away from the fixed contact 630.

As the rotation of pinion gear 210 is restricted by moving the pinion rotation regulating member 230 to the pinion gear side, the strong force conventionally required to rub the regulating portion against the pinion is not necessary, so the pinion rotation regulating member 230 can be accurately moved with the cord-shaped member 680.

Also, because all that is necessary is to cause the regulating claw 231 of the pinion rotation regulating member 230 to engage with the groove 213 on the pinion gear 210, the regulating claw 231 can be reliably moved to the pinion 210 side by the cord-shaped member 680.

By making the cord-shaped member 680 a wire, the durability can be increased.

Also by disposing the adjusting mechanism consisting of the female thread 683 and the fixing screw 684 between the plunger 610 and the cord-shaped member 680, the length of the cord-shaped member 680 can be easily determined.

Furthermore, in the adjusting mechanism, the length of the cord-shaped member 680 can be easily adjusted by screwing the fixing screw 684 constituting the adjusting member into the recess portion 682.

Furthermore, by disposing the cord-shaped member 680 between the plunger 610 of the magnet switch 600 and the pinion rotation regulating member 230 constituting the pinion regulating means through a space between the field magnetic poles 550 of the starter motor 500, the rigid link mechanism such as levers and the like are not necessary and the number of parts can be reduced, and even if the pinion gears 210 fails to move away from the ring gear 100 when the pinion gear 210 meshes the ring gear 100, bending in the cord-shaped member itself causes the plunger 610 to return to its original position, and the movable contacts 611 and 612 can move away from the fixed contact 630. At the same time, because the cord-shaped member 680 passes through a small clearance between the field magnetic poles 550, there is no need to make a space through which the cord-shaped member 680 passes.

[SECOND EMBODIMENT]

Figure 16:
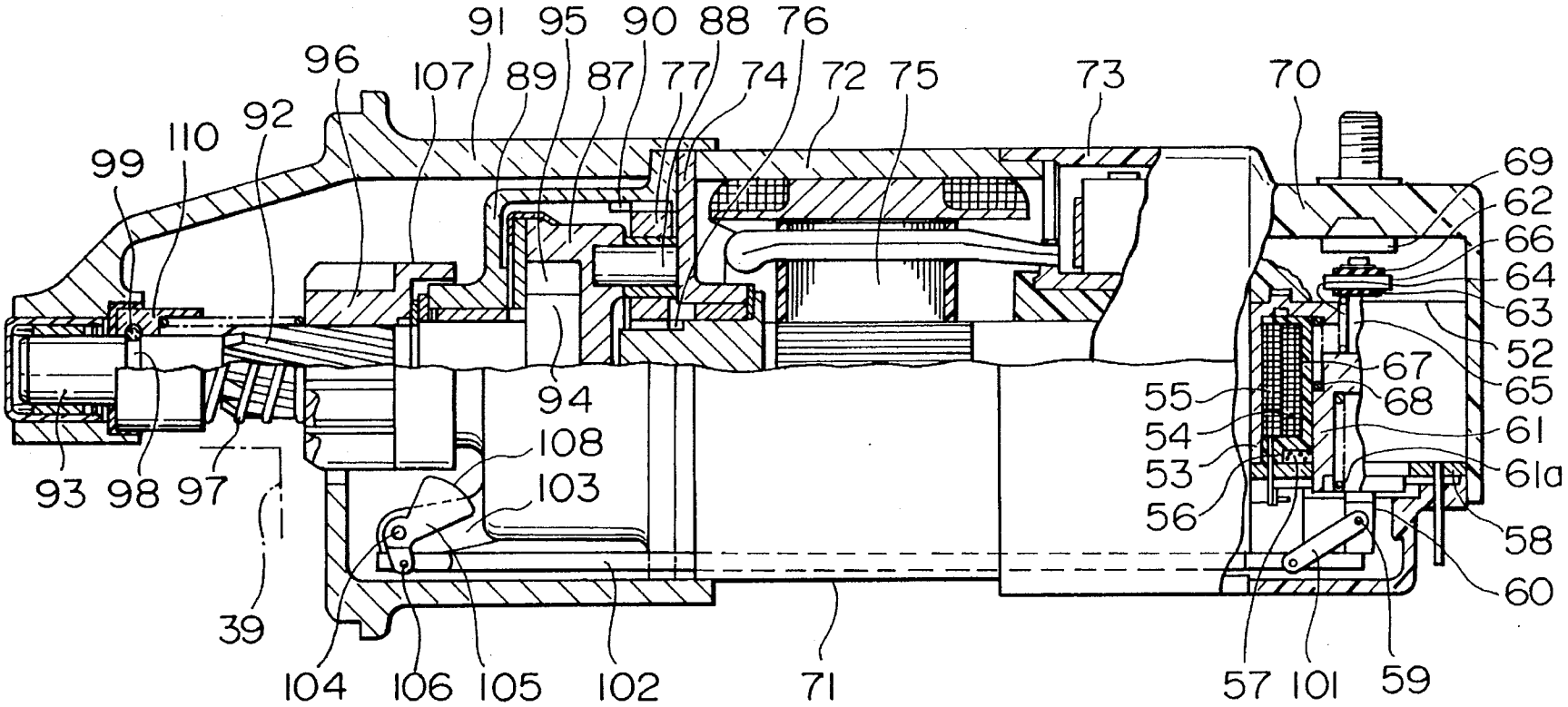
FIG. 16 is a sectional view of the second embodiment of the present invention.
Figure 17:
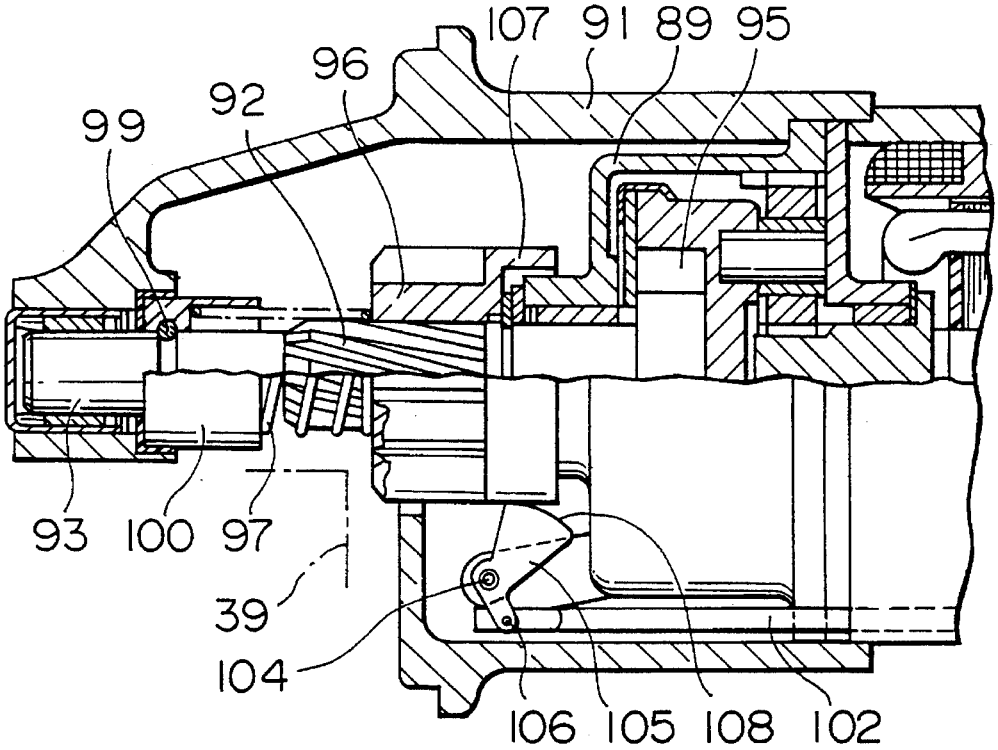
FIG. 17 is a sectional view of the second embodiment of the present invention showing the abutment with a pinion when a lever is operating.
Figure 18:
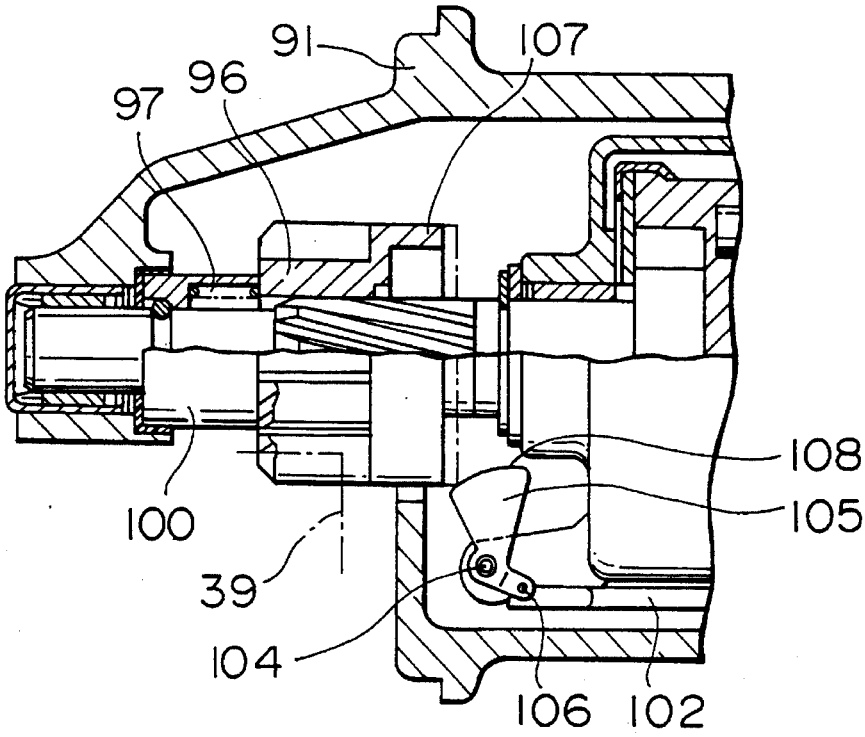
FIG. 18 is a sectional view of the second embodiment of the present invention showing the state when a pinion meshes a ring gear.

The starter according to the second embodiment will be described with reference to FIG. 16 through FIG. 18.

At the rear end opening of a housing 91, a center case 89, a center plate 74, a yoke 72 of a motor 71 and an end frame 73 which will be explained later are secured by a through bolt (not shown) in a unit. A magnet switch 52 is installed at the rear end of the end frame 73. A bobbin 56 having an attracting coil 54 and a holding coil 55 wound therearound is held through a cushion 57 by a plate 58 in a yoke 53 of the magnet switch 52.

At a concave portion of the bottom opening in a plunger 61 which is held through a sleeve 67 in the bobbin 56 to slide upward and downward, a rod 60 and a spring 61*a* are held to be slidable upward and downward. The spring 61*a* biases the rod 60 upward.

The rod 65 is disposed to stand at the upper portion of the plunger 61 and has a movable contact 66 held between insulators 62 and 63 to be movable upward and downward. The movable contact 66 is biased upward by a spring 64. The plunger 61 is biased downward by a return spring 68.

A fixed contact 69 is secured to an insulator cover 70 to face the movable contact 66. The pair of contacts 66 and 69 open or close as the plunger 61 moves upward or downward.

The motor 71 has the yoke 72, the end frame 73 and a rotor 75 which is supported rotatably by the end frame 73 and the center plate 74. A sun gear 76 is formed at the front end of the rotor 75. A planetary gear 77 is rotatably supported by a pin 88 which is driven into an outer member 87 of an overrunning clutch and forms a planetary gear speed reduction mechanism with an internal gear 90 formed in the center case 89.

An output shaft 93 is rotatably supported by the housing 91 and the center case 89 and is formed with a helical spline therearound, and is also provided with an inner member 94 at its rear end portion. The inner member 94 composes the overrunning clutch together with the outer member 87 and a roller pin 95.

At the inner peripheral surface of a pinion 96, there is formed a helical spline to be in mesh with the helical spline 92 of the output shaft 93. The pinion 96 is disposed so as to mesh with the ring gear 39 and is normally biased rearward by a return spring 97. A stop collar 110 which holds the return spring 97 is movably retained or loosely fitted by a ring 99 fitted in a groove 98. The pinion 96 is prevented from further advancing by the stop collar 110.

A link mechanism, i.e. the stopper mechanism in this embodiment, comprises a hinge 101 pivotally connected with the rod 60 and an axially extending rod 102 pivotally connected with the hinge 101. The rod 102 passes through a passage formed in the yoke 72 and the end frame 73 to be pivotally connected with an end of a lever 105, the stopper in this embodiment, by a pin 106. The other end of the lever 105 is movably carried on a flange 103 formed in the center case 89 by a pin 104 so as to rotate therearound as a fulcrum. Further, a resinous sleeve (not shown) to hold the rod 102 slidably is provided within the required position of the axial passage formed in the yoke 72 and the end frame 73.

[OPERATION]

Upon energization of the magnet switch 52 by a battery (not shown), the plunger 61 is attracted, and the plunger 61 pulls the rod 60 upward through the spring 61*a*. The rod 60 drives the rod 102 through the hinge 101 to move backward, and consequently the lever 105 rotates counterclockwise to abut with the outer periphery of a cylindrical portion 107 of the pinion 96 as shown in FIG. 17.

With the rod 60 being elastically or flexibly connected with the plunger 61 through the spring 61*a*, even when the lever 105 abuts the peripheral surface of the cylindrical portion 107 of the plunger 61 and the rod 102 stands still, the plunger 61 is attracted to keep going upward to close the movable contact 66 and the fixed contact 69, so that an electric power is supplied from the battery to the motor 71 to start motor rotation.

The head portion 108 of the lever 105 is shaped to become a wedge against the cylindrical portion 107 of the pinion 96. That is, when the pinion 96 is going to advance to the front side due to relative rotational difference between the pinion 96 and the output shaft 34, the lever 105 is rotated by a frictional force generated by the peripheral surface of the cylindrical portion 107 of the pinion 96 and the lever 105. Consequently, the head portion 108 of the lever 105 abuts the cylindrical portion 107 of the pinion 96 at the portion having the largest diameter, so that the lever 105 generates stronger regulating force.

Thus, the rotation-regulated pinion gear 96 is made to advance on the output shaft 93 toward the ring gear 39 by the helical spline 92. As the pinion 96 advances, the lever 105 turns counterclockwise, the rod 102 is retracted and the rod 60 goes upward in the plunger 61. When the pinion 96 comes in mesh with the ring gear 39, the lever 105 is engaged with the rear end peripheral surface of the cylindrical portion 107 from the peripheral surface of the cylindrical portion 107 as shown in FIG. 18.

When the pinion 96 is going to withdraw, the pinion 96 compresses the spring 61*a* through the lever 105, the rod 102, the hinge 101 and the rod 60, and consequently the lever 105 is biased by the spring 61*a*, so that the lever 105 prevents the retraction of the pinion 96 and the separation of the pinion gear 96 from the ring gear 39 is prevented.

After the engine starting, when the magnet switch 52 is deenergized, the plunger 61 is made go downward by the return spring 68 and the lever 105 turns clockwise to return to the original position, and the pinion 96 is biased by the return spring 97 to return to the original position.

When the pinion 96 and the ring gear 39 abut each other at respective axial teeth end surfaces and fail to mesh with each other and the pinion 96 is not able to advance, the pinion gear rotates against the biasing force of the lever 105 to attain complete meshing with the ring gear 39.

The starter of the second embodiment has the magnet switch 52 housed at the rear portion of the motor 71 and the link mechanism comprising the hinge 101 and the rod 102 passing axially through the peripheral portion of the rotor 75 of the motor 71 to transmit the pulling force. Therefore, the cross sectional area in the axial direction can be reduced, and such effects as simple structure, light weight, and reduced number of parts can be achieved. Further, by the use of the spring 61*a* between the rod 102 and the plunger 61, impact force produced upon engagement of the pinion 96 with the ring gear 39 can be absorbed and contact condition of the movable contact 66 with the fixed contact 69 can be maintained stably.

The present invention having been described with reference to the two embodiments should not be limited but may be modified in many other ways without departing from the spirit and the scope of the invention.

We claim:

1. A starter for an engine with a ring gear comprising:

a starter motor;

an output shaft driven by the starter motor;

a pinion transmittal member including a pinion, engaged with the output shaft by means of a helical spline, which meshes with the ring gear of the engine;

pinion regulating means which by abutting the pinion transmittal member and regulating rotation of the pinion transmittal member moves the pinion to a ring gear side by means of rotation of the output shaft;

a magnet switch disposed at the axially opposite side of the starter motor from the pinion transmittal member and having a fixed contact and a plunger which has a movable contact for abutment with the fixed contact, the magnet switch passing electrical current to the starter motor when the movable contact abuts the fixed contact by the movement of the plunger; and link means provided between the plunger of the magnet switch and the pinion regulating means, wherein the pinion transmittal member is moved to the ring gear side by abutting the pinion regulating means with the pinion transmittal member via the link means by movement of the plunger.

2. A starter according to claim 1, wherein the link means is a cord-shaped member.

3. A starter according to claim 2, wherein the cord-shaped member is a wire.

4. A starter according to claim 2 further comprising:

an adjusting mechanism provided between the cord-shaped member and the plunger to adjust the length of the cord-shaped member.

5. A starter according to claim 4, wherein the adjusting mechanism has:

a hole portion provided in the plunger; and an adjusting member screw-fitted into the hole portion so that the cord-shaped member is fixed to the plunger therethrough, wherein the length of the cord-shaped member is adjusted by screwing the adjusting member into the hole portion.

6. A starter according to claim 2 further comprising:

an adjusting mechanism for adjusting both end portions of the cord-shaped member by moving a supporting member to the extending direction of the cord-shaped member, the supporting member abutting the cord-shaped member.

7. A starter according to claim 1, wherein the pinion regulating means has a regulating portion which fits a groove portion provided on the pinion transmittal member, and wherein the regulating portion is fitted with the grooved portion of the pinion transmittal member via the link means by movement of the plunger.

8. A starter for an engine with a ring gear comprising:

a starter motor;

an output shaft driven by the starter motor;

a pinion transmittal member including a pinion mounted rotatable and axially movably on the output shaft through helical spline engagement for engagement with the ring gear;

pinion regulating means for regulating rotation of the pinion transmittal member and advancing the pinion transmittal member toward the ring gear;

a magnet switch disposed at the axially opposite side of the starter motor from the pinion transmittal member and having a fixed contact and a plunger which has a movable contact for abutment with the fixed contact, the magnet switch passing electrical current to the starter motor when the movable contact abuts the fixed contact by the movement of the plunger; and link means operatively connecting the plunger of the magnet switch and the pinion regulating means, said link means having a flexible member which prevents impact force produced upon engagement of the pinion with the ring gear from being transmitted to the plunger.

9. A starter according to claim 1, further comprising:

one-way clutch means disposed between the starter motor and the pinion transmittal member to transmit a rotation of the starter motor to the output shaft, the clutch means being separated from the pinion transmittal member so that the pinion regulating means operates only on the pinion transmittal member.

10. A starter according to claim 1, further comprising:

return regulating means for preventing a return of the pinion transmittal member after meshing of the pinion with the ring gear.

11. A starter according to claim 10, wherein the return regulating means is coupled with the pinion regulating means and is driven together with the pinion regulating means by the plunger of the magnet switch through the link means.

12. A starter according to claim 1, wherein the link means includes a rod member extending axially through the starter motor.

13. A starter for an engine with a ring gear comprising:

a starter motor;

a one-way clutch;

an output shaft driven by the starter motor through the one-way clutch;

a pinion mounted rotatably and axially movably on the output shaft through helical spline engagement for engagement with the ring gear;

pinion regulating means for regulating rotation of the pinion to cause the pinion to move axially only by way of rotation of the starter motor;

a magnet switch disposed at the axially opposite side of the pinion with respect to the starter motor and having a fixed contact and a plunger which has a movable contact for abutment with the fixed contact, the magnet switch passing electrical current to the starter motor when the movable contact abuts the fixed contact by the movement of the plunger; and link means operatively connecting the plunger of the magnet switch to only the pinion regulating means, the link means being arranged to reduce transmission of impact force produced upon engagement of the pinion with the ring gear to the plunger.

14. A starter according to claim 13, wherein the link means includes a rod extending axially through the starter motor.

* * * * *